United States Patent [19]

Liss et al.

[11] 4,410,420

[45] Oct. 18, 1983

[54] MULTI-ZONE CONVERSION PROCESS AND REACTOR ASSEMBLY FOR HEAVY HYDROCARBON FEEDSTOCKS

[75] Inventors: Barry Liss, New York, N.Y.; Michael Calderon, Spotswood; Marvin S. Rakow, East Brunswick, both of N.J.

[73] Assignee: HRI, Inc., Lawrenceville, N.J.

[21] Appl. No.: 339,277

[22] Filed: Jan. 15, 1982

[51] Int. Cl.[3] ..... C10G 9/32

[52] U.S. Cl. ..... 208/127; 208/156; 208/164

[58] Field of Search ..... 208/127, 156, 164

[56] References Cited

U.S. PATENT DOCUMENTS

| | | | |
|---|---|---|---|
| 2,702,267 | 2/1955 | Keith | 208/156 X |
| 2,861,943 | 11/1958 | Finneran, Jr. et al. | 208/156 X |
| 2,875,147 | 2/1959 | Engle | 208/164 X |
| 2,885,342 | 5/1959 | Keith | 208/156 X |
| 2,952,617 | 9/1960 | Haig | 208/127 |
| 3,033,779 | 5/1962 | Fidelman | 208/127 |
| 3,202,603 | 8/1965 | Keith et al. | 208/164 X |
| 4,318,800 | 3/1982 | Woebcke et al. | 208/127 |

*Primary Examiner*—Curtis R. Davis
*Assistant Examiner*—Glenn A. Caldarola
*Attorney, Agent, or Firm*—V. A. Mallare; F. A. Wilson

[57] ABSTRACT

A multi-zone fluidized bed hydrocarbon conversion process and apparatus for producing gas and distillable liquid products from heavy hydrocarbon feedstocks. The feedstock is introduced into an upper fluidized bed primary cracking zone maintained at temperature of 850°-1400° F. for cracking reactions therein, and resulting tars and coke are deposited on and within a particulate carrier material contained therein. The carrier material containing said tars and coke descends successively through a stripping zone to remove tars and an interim controlled temperature zone for secondary cracking against an upflowing hot reducing gas, then descends into a lower fluidized bed gasification zone. The gasification zone is maintained at temperature of 1600°-1900° F. by oxygen-containing gas and steam introduced therein to gasify the coke deposits and produce the reducing gas. The stripping zone contains a stationary packing material such as coarse particulate packing which is supported by a refractory apertured grid, or an ordered array of multiple structural members. The decoked hot particulate carrier material is recirculated upwardly through a transfer conduit to the upper fluidized bed primary cracking zone by a transport gas. Hydrocarbon liquid and gas products are withdrawn from the upper cracking zone.

14 Claims, 2 Drawing Figures

MULTI-ZONE CONVERSION PROCESS AND REACTOR ASSEMBLY FOR HEAVY HYDROCARBON FEEDSTOCKS

BACKGROUND OF INVENTION

This invention pertains to a process for cracking and hydroconversion of heavy hydrocarbon feedstocks such as crude or residual oils to produce lighter hydrocarbon liquids such as naphtha and distillates and fuel gas products. It pertains particularly to such a process and reactor apparatus utilizing multiple zones containing fluidized beds of particulate carrier material to facilitate cracking the feedstock in an upper zone and gasification of coke deposits on the carrier in a lower zone.

Considerable work has previously been done for the multi-zoned conversion of heavy oil feedstocks using a circulated particulate carrier material. A typical process utilizes a three-zone reactor having an upper zone for primary cracking, an intermediate zone for stripping-/secondary cracking and a lower zone for combustion/-gasification, with each zone containing a fluidized bed of particulate carrier material which is contiguous from zone to zone. The feedstock is first cracked on and within the particulate carrier material in the upper zone and carbon is deposited on and within the carrier, after which the carbon-laden particulates descend through the stripping zone countercurrent to a rising flow of hot reducing gas. The carrier material is regenerated by partial oxidation of the carbonaceous material in the gasification zone, and is recycled by a transport gas in a riser conduit into the primary cracking zone to provide the heat of reaction therein. Some typical pertinent patents include U.S. Pat. Nos. 2,861,943 to Finneran, 2,885,342 to Keith, and 2,885,343 to Woebcke, which disclose the use of a circulating particulate carrier for coke laydown from cracking crude and residual oil feedstocks. Also, U.S. Pat. Nos. 2,875,150 to Schuman and 3,202,603 to Keith et al disclose multi-bed hydrocracking and conversion processes for residual oils and tar feeds using a particulate carrier material for hydrocracking the heavy oil feed to produce gas and liquid fractions.

In such a conversion process for heavy hydrocarbon feedstocks, it is desirable to maintain a large temperature gradient across the fluidized bed stripping zone separating the primary cracking and gasification zones. However, such a temperature gradient is difficult to achieve in a stable dense phase fluidization regime. Poor gas-solids contact between the stripping and gasification zones can limit secondary cracking temperatures achieved in the stripping zone. Mechanical design of the fluidized bed stripping zone must account for it being adjacent to the gasification zone, which is at the preferred temperatures of 1600°-1900° F. Also, control of the recirculating flow of hot decoked carrier solids requires throttling through a hot valve, thus contributing to mechanical design complexity.

The hydrocarbon conversion process and apparatus of the present invention provides an improvement over prior art hydrocracking processes, by providing an interim zone located between the stripping zone and lower gasification zone and arranged for achieving improved control of temperature, carrier solids flow and secondary cracking reactions in that region.

SUMMARY OF INVENTION

This invention provides an improved multi-zone conversion process and reactor system for upgrading heavy hydrocarbon feedstocks, to produce lighter hydrocarbon liquid and gas products. The invention utilizes a four-zone reactor vessel having an upper primary cracking or conversion zone and a lower gasification or combustion zone, maintained at higher temperature, separated by an intermediate stripping zone and a subadjacent interim zone. These four reactor zones all contain fluidized beds of a particulate carrier material, which is continuously circulated through the zones and fluidized by upflowing gases. The feedstock is cracked in the fluidized bed primary cracking zone at temperature within the range of 850°-1800° F. to provide liquid and gas product, and coke is deposited on and within the carrier material. The coke-containing carrier, containing adsorbed high-boiling refractory liquid and coke deposits, descends downwardly into the stripping zone which contains a stationary packing material or structure of sufficient voidage to assure downward passage of the particulate carrier material therethrough. An interim zone is advantageously provided between the stripping zone and the lower gasification zone to provide improved control of temperatures at that point and thereby control the extent of stripping and secondary cracking of hydrocarbon residues contained on the descending carbon-laden particulate carrier material within the reactor, prior to transfer of the particulate carrier to the lower gasification zone. The gasification zone is maintained at temperature within the range of 1600°-1900° F. by oxygen-containing gas and steam to gasify the coke deposits and produce the reducing gas. The hot decoked particulate solids are then recycled to the primary cracking zone.

The interim zone thus provides a specific thermal control means located between the stripping zone and lower gasification zone, so as to better control secondary cracking of the feed material and selectivity of liquid product yields. It also minimizes the amount of carbonaceous material transported to the gasification zone by the carrier material, and incorporates the ability to control carrier material flow and communication with a solids flow valve. Temperature in the interim zone is usually maintained in the range of 1000°-1600° F.

Utilization of the fluidized bed interim zone for improved temperature control in the four-zoned reactor has several advantages. It permits using a more open packed bed or ordered array design in the stripping zone, i.e., having increased voidage, which enhances particulate carrier fluidization performance and provides greater control of the hydrocarbon liquid product yields and their distribution. Also, the interim zone provides maximum secondary cracking of high molecular weight moeties such as multi-ring aromatics and contributes to hydrogen production therein.

DETAILED DESCRIPTION OF DRAWINGS

Figures 1, 2:
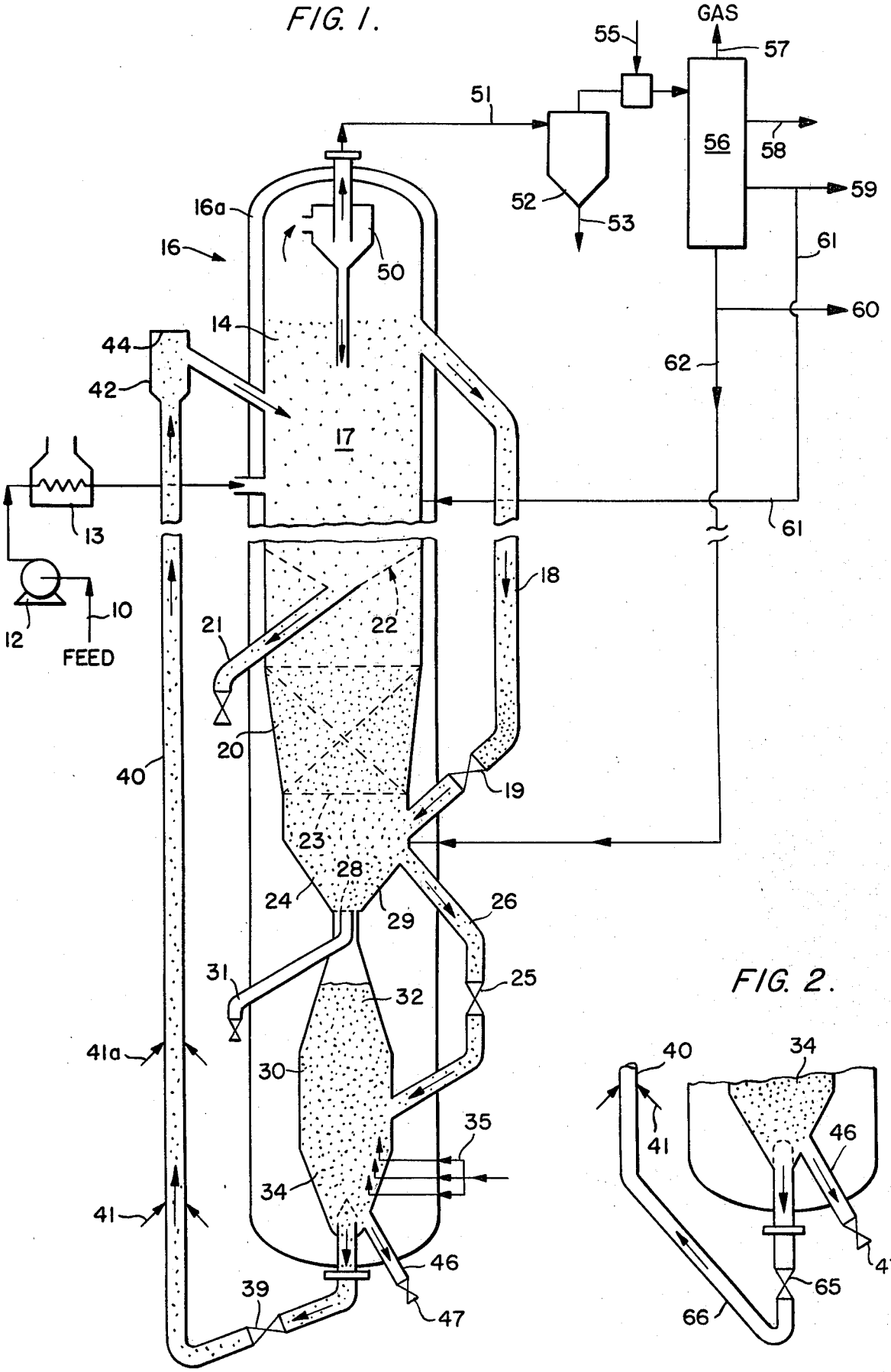

FIG. 1 is an elevated view of a multi-zone reactor according to the present invention; and FIG. 2 is a view of an alternative configuration of the solids recycle arrangement of the reactor of FIG. 1.

In the present invention, the hydrocarbon conversion process and reactor system consists of four principal vertically-staged and interconnected fluidized bed zones, which are further appropriately connected by various downflow standpipes and an upflow dense phase riser conduit. In the process, the hydrocarbon feedstock, such as heavy petroleum crude or residual oil, shale oil, tar sand bitumen and their residues, and mixtures with coal, is preheated and injected at an appropriate level into a fluidized bed of particulate carrier material located in the upper primary cracking zone. Additionally, certain portions of the distillable liquid product may be recycled to this zone to permit cracking thereof. This zone is maintained at temperatures of 850°-1400° F., and at total pressure usually within the range of 200-800 psig, although higher pressure could be used. The feed material is absorbed by the bed of porous carrier particles and cracks to produce vapor and liquid products, and also produces coke deposits on and within the carrier material. The hydrogen partial pressure provided in the cracking zone by an upflowing reducing gas limits the extent of coke formation, and a favorable product yield distribution is produced compared to a conventional fluidized bed coking operation. The heat for the primary cracking zone is provided mainly by hot particulate carrier material recycled from the lower gasification zone. The hot particulate carrier material is lifted by a transport gas in a dense phase riser conduit into the upper cracking zone to provide the heat of reaction therein and to balance the process sensible heat requirements. Also, the upflowing reducing gas, produced by partial oxidation in the lower gasification zone of the coke deposited on the carrier material, passes upwardly through the interim and stripping zones and provides the fluidizing/reagent gas for the feedstock hydrocracking which occurs in the primary cracking zone, as well as a portion of the heat requirements in the cracking zone. Such reducing gas principally contains hydrogen carbon monoxide, steam and carbon dioxide.

The stripping zone located immediately below the primary cracking zone contains a stationary packing material preferably comprising multiple horizontal structural members or a coarse particulate packing material sized to restrict axial solids mixing so as to provide a substantial vertical temperature gradient of 150°-750° F., thereby creating a non-isothermal countercurrent stripping/secondary cracking zone. If a coarse particulate packing is used, a packing support structure is provided which permits sufficient downflow of the particulate carrier solids and upflow of reducing gas through the stripping zone to accomplish effective stripping of hydrocarbon liquid from the packing. Multiple horizontal structural members can be installed without the need for a support structure. Above the stripping zone, a scalping screen can be provided to prevent any agglomerates which may form in the primary cracking zone from descending and plugging the packing material of the stripping zone.

At the lower end of the stripping zone, an interim zone is provided which is void of packing material but contains fluidized particulate carrier and therefore is a region which approaches isothermal behavior. Any liquid remaining on or within the descending particulate carrier material from the stripping zone is cracked in the interim zone. The temperature in the interim zone is controlled mainly by a combination of three flows of the particulate carrier solids, namely:

(a) downward from the primary cracking zone through the stripping zone into the interim zone;
(b) downward from the interim zone into the gasification zone; and
(c) hot solids entrained upwardly from the gasification zone by rising flow of reducing gas into the interim zone.

The interim zone temperature will thereby usually be maintained within the range of 1000°-1600° F. Thus, this interim zone provides for more reliable control of the stripping/secondary cracking zone exit temperature to assure complete cracking of the more refractory and higher boiling species of the feedstock. The interim zone temperature is controlled mainly by the circulation rate of carrier solids between the interim and gasification zones, which rate is achieved by the positioning of a valve in a downflowing standpipe.

The interim and gasification zones are separated by a grid structure, which acts to properly distribute the gas and solids entrained from the gasification zone and provide the desired thermal barrier between these zones. In this manner, the interim and gasification zones can be operated independently over the desired broad range of practical temperatures, allowing process optimization to feedstock variation as well as market demand constraints without risking operability or requiring an impractical mechanical design for the stripping zone. An agglomerate removal sump integral within the grid, is provided at the bottom of the interim zone to prevent fine agglomerates or clinkers that might collect there from causing maldistribution of the hot upflowing reducing gas. The sump for such clinker collection is also arranged to allow for their removal during operations, if such are produced during a transient period or system upset.

A stripping zone bypass conduit can also be provided to extend the feedstock throughput capacity of the multi-zone reactor. Use of this bypass allows stable operation of the fluidized bed primary cracking zone at higher upflowing gas velocities by providing auxiliary capacity to achieve a net downward flow of particulate carrier solids. The bypass conduit also allows for reduced carrier material flow downward through the stripping zone in the event reactor operations might make that desirable. The design of the stripping zone packing structure or material can be such that either a small fraction or most of the sensible heat supplied to the primary cracking from the lower gasification zone occurs by vertical solids thermal diffusivity through the stripping zone. This allows independent control of the stripping zone temperatures over a broad range of potential operating conditions.

The upper portion of the gasification zone is reduced in diameter and so contoured to produce the desired solids entrainment rate by the upflowing reducing gas corresponding to the heat balance requirements. Also, the grid plate separating the gasification and interim zones is sized to operate with sufficient pressure drop to assure good redistribution of the upflowing reducing gas. This grid member is made of refractory material and preferably is arch-shaped to prevent cracking of the grid as a result of any substantial pressure surges. A reduction of solids feed into the gasification zone by slightly closing the valve in the bypass standpipe connecting the interim and gasification zones causes the fluid bed level in the gasification zone to drop and thereby reduces upward entrainment of hot particulate carrier material. Such reduced solids entrainment is produced by the combined effect of the aforementioned gasification zone contour and relative position of the effective particle transport disengaging height.

The desired temperature in the gasification zone of 1600°-1900° F. is maintained by the gasification and combustion of the coke deposited on and within the carrier material. Oxygen and steam are injected through nozzles located circumferentially and vertically across a conical tapered section at the lower end of the gasification zone. A portion of the total steam is used to fluidize the solids in the gasification zone to provide a well mixed zone, into which the oxygen can be injected without clinkering or sintering of the carrier material. The zone is tapered outwardly in the region of oxygen injection to sustain the desired uniform fluidizing velocity to promote oxygen dispersion.

Hot decoked particulate solids are withdrawn from the gasification zone base into a dense phase fluidized standpipe, through a solids flow valve, and a reverse lateral conduit creating a high resistance zone. The solids are then lifted by addition of a transport gas or steam to the dense phase riser conduit, and are transferred to the primary cracking zone. In this manner, solids flow control can be achieved by the positioning of the lift gas entry points and adjustment of the lift gas flows to those points. In turn, the solids flow valve, which must be exposed to high gasification zone temperatures, can usually be operated wide open or at least without requiring throttling action during normal operations. A solids withdrawal system is also provided at the bottom of the gasification zone. This system can be used to remove any sintered or clinkered solids that may form in this zone.

The selection of a suitable particulate carrier material with respect to its absorptivity, pore size, pore volume and other appropriate characteristics, is such as to collect substantially all high boiling refractory species and coke produced in the upper primary cracking zone, as well as to effect the desired cracking reactions without agglomeration of material. The particulate carrier may be selected from among naturally occuring or synthetic alumina, aluminosilicate, or similar material having the necessary absorptive characteristics. The desired particles size can include material having average particle diameter between about 40 and 250 microns.

As illustrated by FIG. 1, a hydrocarbon feedstock material at 10, such as heavy petroleum crude or residual oil, is pressurized at 12, preheated at 13 and injected at an intermediate level into the upper primary cracking zone 14 of multi-zone reactor 16. Zone 14 contains a fluidized bed 15 of particulate carrier material 17.

The cracking zone 14 is maintained at temperatures of 850°-1400° F. and at total pressure usually within the range of 200-800 psig. The feed material is absorbed by the bed 15 of porous carrier particles 17 and is cracked to produce liquid and vapor products, and also produces coke deposits on and within the carrier material. The hydrogen partial pressure is provided in the cracking zone 14 by an upflowing reducing gas which limits the extent of coke formation, and produces a favorable product yield distribution. The resulting vapor phase products are passed upwardly through a cyclone separator 50 and are removed as stream 51. The heat for primary cracking zone 14 is provided mainly by hot particulate carrier material recycled from lower gasification zone 34 and lifted by a transport gas in a dense phase riser conduit 32 into the upper cracking zone 14 to provide the heat of reaction therein. Also, the upflowing hot reducing gas, produced by partial oxidation in the lower gasification zone 34 of the coke deposited on the particulate carrier material, passes successively upwardly through the interim and stripping zones and provides the fluidizing/reagent gas for the feedstock hydrocracking which occurs in the primary cracking zone 14. The upflowing reducing gas contains principally hydrogen, carbon monoxide, steam and carbon dioxide.

The stripping zone 20 located immediately below the primary cracking zone 14 contains a stationary packing comprising multiple structural members 21 or a coarse particulate packing material designed to restrict top-to-bottom solids mixing so as to provide a substantial vertical temperature gradient of 150°-750° F., thereby creating a non-isothermal countercurrent stripping/secondary cracking zone. If a course particulate packing material is used in zone 20, a packing support structure is provided which permits sufficient downflow of the particulate carrier solids and upflow of reducing gas through the stripping zone to accomplish effective stripping of hydrocarbon liquid from the packing. Above the stripping zone 20, a scalping screen 22 is preferably provided to prevent any agglomerates which may form in the primary cracking zone from descending and plugging the packing material bed of the stripping zone.

At the lower end of the stripping zone 20, an interim zone 24 is provided which is void of packing material but contains fluidized particulate carrier material and therefore approaches isothermal conditions. Any high boiling liquid remaining on or within the particulate carrier material from the stripping zone 20 is cracked in the interim zone 24. The temperature in the interim zone 24 is controlled mainly by a combination of flows of the particulate carrier solids. The solids flow downwardly from the primary cracking zone through the stripping zone into the interim zone for further heating, and then downward from the interim zone into the gasification zone. Also, hot solids are entrained upwardly from the gasification zone by rising flow of reducing gas upward into the interim zone.

The interim zone temperature will thereby usually be maintained within the range of 1000°-1600° F., and preferably at 1100°-1500° F. The interim zone temperature is controlled mainly by the circulation rate of carrier solids between the interim and gasification zones, which circulation is achieved by the positioning of slide valve 25 in a downflowing standpipe 26. For example, if valve 25 is open and more solids are transferred downwardly into the gasification zone 30, the fluidized bed level in this zone rises and more hot solids will be entrained upwardly into the interim zone 24 by the upflowing reducing gas.

The interim and gasification zones are separated by grid structure 28, which acts as a thermal barrier permitting the high temperatures required for economic gasification of the coke residue to be limited to the gasification zone. An agglomerate removal sump 29 integral within the grid, is provided at the bottom of the interim zone to prevent fine agglomerates or clinkers that might collect there from causing maldistribution of the hot upflowing reducing gas. The sump for such clinker collection is also arranged to allow for their on-line removal if such are produced during a transient period or system upset condition.

A stripping zone bypass conduit 18 and valve 19 are provided to extend the feedstock throughput capacity of the multi-zone reactor 16. Use of this bypass allows stable operation of the fluidized bed primary cracking zone at higher upflowing gas velocities than a particular design rating by providing auxiliary capacity to achieve a net downward flow of particulate carrier solids through conduit 18. The bypass conduit also allows for reduced carrier material flow downward through the stripping zone 20 in the event reactor operations so warrant. The design of the stripping zone packing structure or material is such that either a small fraction or most of the sensible heat supplied to the primary cracking zone from the lower gasification zone occurs by vertical solids thermal diffusivity through the stripping zone.

The upper portion 32 of the gasification zone 30 is reduced in diameter and contoured so as to produce the desired solids entrainment rate by the upflowing reducing gas corresponding to the heat balance requirements. Also, the grid plate 28 separating the gasification and interim zones is sized to operate with sufficient pressure drop to assure good redistribution of the upflowing reducing gas from zone 32. This grid member 28 is made of refractory material such as Cerox 600, obtained from C-E Refractories, Inc. This grid is preferably made arch-shaped to prevent cracking of the grid as a result of any substantial pressure surges several multiples of its design rating. A reduction of solids feed into the gasification zone 30 by slightly closing the valve 25 in the bypass standpipe 26 causes the fluid bed level in the upper portion of the gasification zone 34 to drop, and thereby reduces upward entrainment of hot decoked particulate carrier material 17. The reduced solids entrainment is produced by the combined effect of the aforementioned contour in gasification zone 32 and relative position of the effective particle transport disengaging height.

The desired gasification zone temperature of 1600°-1900° F. is maintained by the gasification and combustion of the coke deposited on and within the carrier material 17. Oxygen is injected along with steam through a series of nozzles 35 located circumferentially and vertically across a conical tapered section 34 at the base of the gasification zone 30. A portion of the total steam is used to fluidize the carrier solids in the gasification zone to provide a well mixed zone, into which the oxygen can be injected without producing clinkering or sintering of the carrier material. The zone is tapered outwardly at the lower end to sustain the desired uniform fluidizing velocity to promote oxygen dispersion. A separate row of steam nozzles are preferably provided at the top of the tapered oxygen injection zone to enhance fluid bed stability and minimize channeling. If desired, oxygen can be injected with steam.

Hot decoked particulate solids are withdrawn through lateral conduit 38 from the base of gasification zone 30 and passed into a dense phase fluidized standpipe 40, through a solids flow valve 42, said lateral and reverse standpipe creating a high resistance zone. The particulate solids are then lifted by introduction of a transport gas such as steam or product fuel gas at 41 and/or 41*a* into the dense phase riser conduit 40, and are transferred upward to the primary cracking zone 14. In this manner, flow control of the hot particulate solids can be achieved by the positioning of the lift gas entry points and adjustment of the lift gas flows to those points. In turn, the solids flow valve 39, which must be exposed to high gasification zone temperatures, can usually be operated wide open or at least without requiring throttling action during normal operations. An enlarged reversal member 42 having hard impact surface 44 made of a refractory material is provided for returning solids to primary cracking zone 14.

A solids withdrawal conduit 46 and valve 47 are also previded at the bottom of the gasification zone 30. This system can be used to remove any sintered or clinkered solids from the gasification zone.

Depending on the feedstock used, liquid and gas products along with the minor amount of small particle size unconverted coke and a larger portion of small particle size solids, leave the reactor upper zone as stream 51 and pass to an external cyclone solids separation system 52. This separation step removes any remaining coke and solids particles from the product gas stream as stream 53. This stream may be recycled to the reaction vessel or discarded. The resulting cyclone effluent stream 54 is then usually quenched at 55, such as by an oil stream, or otherwise cooled to reduce its temperature and limit or prevent further undesired reactions. The cooled liquid and gas are then separated using conventional fractionation means at 56 to provide a product gas stream 57, naphtha liquid stream 58, light distillate liquid stream 59, and heavy distillate liquid product fraction 50. The light distillate liquid will usually have an initial boiling point of about 400° F. and a final boiling point in the range of 600°-1000° F.; the heavy distillate liquid will have an initial boiling point of 600° F. plus. If desired, a portion 61 of the heavy fraction 59 can be recycled to the primary cracking zone 14 for further reaction. Also, a portion 62 of heavy liquid stream 60 can be recycled to the interim zone 24 for further cracking reaction therein. In addition, a portion of stream 57 can be recycled for use as the lift gas 41 or 41*a* into conduit 40.

An alternative configuration for recycle of hot decoked particulate solids to the primary cracking zone is shown in FIG. 2. The hot decoked carrier solids are passed downwardly through control valve 65 and then into ascending lateral portion 66 of the conduit 40.

EXAMPLE

A petroleum residuum feedstock is fed into the upper fluidized bed primary cracking zone of a four-zone reactor and hydrocracked on a particulate carrier material. Operating conditions used and products obtained are given in Table 1 below.

TABLE 1

| | |
|---|---|
| Feeds | |
| Residuum, bbl/day | 5100 |
| Oxygen, ton/day | 192 |
| Steam, ton/day | 216 |
| Temperature, °F. | |
| Primary Cracking Zone | 1000 |
| Stripping Zone | 1000-1400 |
| Interim Zone | 1400 |
| Gasification Zone | 1800 |
| Pressure, psig | 250 |
| Products | |
| Fuel Gas, SCF/day | 12,900,000 |
| Naphtha, bbl/day | 2332 |
| 400-900° F. Distillate Oil, bbl/day | 1474 |

In this example, some of the 400°-900° F. distillable product stream is recycled to the primary cracking zone at a ratio of 0.5 volumes of recycle per 1.0 volume of fresh feed.

A packed fluidized bed stripping zone produces a temperature gradient of 10°-60° F./ft of height and redistributes the raw reducing gas to provide the fluidizing gas for the primary cracking zone. A net flow of 250,000 lb/hr of carrier material descends against the fluidizing reducing gas. In the interim zone below the stripping zone, an isothermal bed is maintained at about 1400° F. by withdrawing 390,000 lb/hr of carrier material down the bypass standpipe, and into the gasification zone and by entraining 140,000 lb/hr of carrier at about 1800° F. up from of the gasification zone across the grid with the hot reducing gas produced in that zone.

Although we have disclosed certain preferred embodiments of our invention it is recognized that various modifications can be made thereto and that some features can be employed without others, all within the spirit and scope of the invention which is defined solely by the following claims.

We claim:

1. A process for conversion of heavy hydrocarbon feedstocks to provide lighter hydrocarbon liquids and gas products, comprising:

(a) introducing a hydrocarbon feedstock into a pressurized upper fluidized bed primary cracking zone maintained at a temperature within the range of 850°–1400° F., said cracking zone containing a bed of particulate carrier material fluidized by upflowing reducing gases passing therethrough and providing primary cracking of the feedstock;

(b) passing the carrier material containing heavy hydrocarbon liquid and coke deposits from said cracking zone downwardly through a non-isothermal stripping zone contains a stationary packing to strip and further crack the liquid;

(c) passing the carrier material containing coke deposits downwardly into a subadjacent essentially isothermal interim zone free of packing to provide temperature control and secondary cracking of any remaining liquid at a controlled temperature within the range of 1000°–1650° F.;

(d) passing the carrier material from said interim zone downwardly into a lower fluidized bed gasification zone to gasify said coke deposits from the carrier material;

(e) injecting an oxygen-containing gas and steam into the lower gasification zone for reaction with said coke deposits on and within the carrier material and maintaining the gasification zone temperature within the range of 1600°–1900° F. for gasification and combustion of coke and to produce the reducing gases;

(f) passing said reducing gases upwardly successively through said interim zone, stripping zone and through said upper primary cracking zone to fluidize the beds, therein;

(g) passing the resulting hot decoked particulate carrier material from the lower gasification zone to a vertical transfer conduit, and recycling said solids upwardly into the upper primary cracking zone using a transport gas flowing in said conduit at velocity sufficient to carry said solids; and (h) withdrawing effluent vapor phase products from said upper cracking zone.

2. The process according to claim 1, wherein a portion of the particulate carrier material is passed downwardly from the primary cracking zone directly into the interim zone through a downcomer conduit.

3. The process according to claim 1, wherein a major portion of the particulate carrier material is passed from the interim zone downwardly to the lower gasification zone through a conduit.

4. The process according to claim 1, wherein a portion of the hot particulate solids from the gasification zone is entrained upward into the interim zone by the rising flow of the reducing gas to increase the temperature in the interim zone.

5. The process of claim 1, wherein spent carrier material and ash is withdrawn from the bottom of the gasification zone.

6. The process according to claim 1, wherein the recycle of the decoked particulate carrier solids from the lower gasification zone to the upper cracking zone is controlled by passing the solids and the transport gas upwardly through an externally located transfer conduit and control valve.

7. The process according to claim 6, wherein the upflowing transport gas velocity in said transfer conduit is at least about 6 ft/sec.

8. The process according to claim 1, wherein said effluent stream contains some particulate matter which is separated from the gas external to said reaction zones, the particulate matter is recycled to the reaction vessel, and the resulting clean effluent stream is cooled and passed to a fractionation step for recovery of gas and distillable liquid products.

9. The process according to claim 1, wherein the effluent vapor base products are cooled and passed to a fractionation step, from which a portion of a light distillate liquid is recycled to the primary cracking zone.

10. The process according to claim 1, wherein the effluent vapor phase products are cooled and passed to a fractionation step, from which a portion of a heavy distillate liquid is recycled to the interim zone.

11. The process of claim 1, wherein the feedstock is crude petroleum oil or residual fractions thereof.

12. The process of claim 1, wherein the feedstock is shale oil or residual fractions thereof.

13. The process of claim 1, wherein the feedstock is tar sand bitumen or residual fractions thereof.

14. The process according to claim 1, wherein the feedstock contains coal particles, and including the additional step of withdrawing particulate ash from a lower portion of said gasification zone.

* * * * *